US008616303B2

(12) United States Patent
Rupp et al.

(10) Patent No.: US 8,616,303 B2
(45) Date of Patent: Dec. 31, 2013

(54) HELICAL DRILLING APPARATUS, SYSTEMS, AND METHODS

(75) Inventors: Michael D. Rupp, Murray, UT (US); Christopher L. Drenth, Draper, UT (US); Christian M. Lambert, Draper, UT (US)

(73) Assignee: Longyear TM, Inc., South Jordan, UT (US)

( * ) Notice: Subject to any disclaimer, the term of this patent is extended or adjusted under 35 U.S.C. 154(b) by 392 days.

(21) Appl. No.: 13/024,220

(22) Filed: Feb. 9, 2011

(65) Prior Publication Data

US 2011/0127086 A1 Jun. 2, 2011

Related U.S. Application Data

(63) Continuation-in-part of application No. 12/732,106, filed on Mar. 25, 2010, now Pat. No. 8,006,783.

(60) Provisional application No. 61/163,760, filed on Mar. 26, 2009.

(51) Int. Cl.
*E21B 7/00* (2006.01)
*E21B 10/08* (2006.01)

(52) U.S. Cl.
USPC ..... 175/57; 175/101; 175/273; 175/394; 475/11

(58) Field of Classification Search
USPC ..... 175/61, 342, 352, 371, 372, 173, 92; 475/11
See application file for complete search history.

(56) References Cited

U.S. PATENT DOCUMENTS

| | | | | |
|---|---|---|---|---|
| 1,068,015 | A | 7/1913 | Stewart | |
| 1,427,064 | A * | 8/1922 | Caverly | 175/273 |
| 1,612,338 | A * | 12/1926 | Wilson et al. | 173/15 |
| 2,530,502 | A | 11/1950 | Baney | |
| 3,161,243 | A | 12/1964 | Davis | |
| 3,669,199 | A | 6/1972 | Cullen et al. | |
| 3,966,257 | A | 6/1976 | Shah | |
| 4,009,909 | A | 3/1977 | Robbins et al. | |
| 4,074,778 | A | 2/1978 | Morrell et al. | |

(Continued)

FOREIGN PATENT DOCUMENTS

| | | | |
|---|---|---|---|
| JP | 2002-013598 | A | 1/2002 |
| KR | 20-0390761 | Y1 | 7/2005 |

OTHER PUBLICATIONS

Issue Notification dated Aug. 10, 2011 from U.S. Appl. No. 12/732,106 filed Mar. 25, 2010 (1 page).

(Continued)

*Primary Examiner* — Jennifer H Gay
(74) *Attorney, Agent, or Firm* — Ballard Spahr LLP

(57) ABSTRACT

A down-the-hole assembly includes a housing having a central axis and a mechanical gear box positioned within the housing. The mechanical gear box is coupled to the housing such that rotation of the housing at a first rotational rate provides a rotary input to the mechanical gear box. A rotary cutting bit is coupled to the mechanical gear box. The mechanical gear box is configured to rotate said rotary cutting bit at a second rotational rate in response to that rotary input from the housing. The second rotational rate is greater than the first rotational rate. The mechanical gear box is also further configured to cause the rotary cutting bit to orbit about the central axis of the housing.

24 Claims, 5 Drawing Sheets

(56) References Cited

U.S. PATENT DOCUMENTS

| | | | | |
|---|---|---|---|---|
| 4,080,115 | A | 3/1978 | Shirley | |
| 4,267,893 | A | 5/1981 | Mannon, Jr. | |
| 4,303,277 | A | 12/1981 | Roepke et al. | |
| 4,627,501 | A | 12/1986 | Ebeling | |
| 4,678,045 | A | 7/1987 | Lyons | |
| 4,930,585 | A | 6/1990 | Noser et al. | |
| 5,845,721 | A | 12/1998 | Southard | |
| 7,143,845 | B2 | 12/2006 | Leppanen | |
| 7,497,279 | B2 | 3/2009 | Hall et al. | |
| 7,600,586 | B2 | 10/2009 | Hall et al. | |
| 7,610,970 | B2 | 11/2009 | Sihler et al. | |
| 8,006,783 | B2 * | 8/2011 | Rupp et al. | 175/57 |
| 2007/0119630 | A1 | 5/2007 | Hall et al. | |
| 2008/0135292 | A1 * | 6/2008 | Sihler et al. | 175/27 |
| 2010/0212966 | A1 | 8/2010 | Hall et al. | |
| 2010/0243331 | A1 | 9/2010 | Rupp et al. | |
| 2011/0127086 | A1 * | 6/2011 | Rupp et al. | 175/57 |

OTHER PUBLICATIONS

International Search Report, mailed Jun. 22, 2010, as issued in connection with corresponding PCT Application No. PCT/US2010/028862 filed on Mar. 26, 2010.

Office Action mailed on Oct. 21, 2010 in U.S. Appl. No. 12/732,106 (8 pages).

Notice of Allowance dated Mar. 18, 2011 from U.S. Appl. No. 12/732,106, filed Mar. 25, 2010 (8 pages).

International Search Report issued by the International Bureau on Sep. 12, 2012 for PCT/US2012/023665 filed on February and published as WO 2012/109090 on Aug. 16, 2012 (Applicant—Longyear TM, Inc. // Inventors—Rupp et al. //) (3 pages).

* cited by examiner

HELICAL DRILLING APPARATUS, SYSTEMS, AND METHODS

CROSS-REFERENCE TO RELATED APPLICATIONS

This application is a continuation-in-part of prior U.S. patent application Ser. No. 12/732,106 filed on Mar. 25, 2010 and entitled "HELICAL DRILLING APPARATUS, SYSTEMS, AND METHODS," which claims the benefit of U.S. Provisional Application No. 61/163,760 filed Mar. 26, 2009 and entitled "HELICAL DRILLING APPARATUS, SYSTEMS, AND METHODS." The contents of each of the above-referenced patent applications are hereby incorporated by reference in their entirety.

BACKGROUND OF THE INVENTION

1. The Field of the Invention

The present invention down-the-hole tools and to down-the-hole drilling mechanisms in particular.

2. The Relevant Technology

While many different drilling processes are used for a variety of purposes, in most drilling process a drill head applies axial forces (feed pressure) and rotational forces to drive a drill bit into a formation. More specifically, a bit is often attached to a drill string, which is a series of connected drill rods that are coupled to the drill head. The drill rods are assembled section by section as the drill head moves and drives the drill string deeper into the desired sub-surface formation. One type of drilling process, rotary drilling, involves positioning a rotary cutting bit at the end of the drill string. The rotary cutting bit often includes (tungsten carbide or optimally, synthetic diamonds, TSD or PCD cutters) that are distributed across the face of the rotary cutting bit.

The rotary cutting bit is then rotated and ploughed into the formation under significant feed pressure. The velocity of each cutting element depends on the angular rotational rate of the bit and the radial distance of the element from the center of the bit. On a solid drill bit, the angular rotational rate will be the same for the entire bit. Accordingly, at any given speed those cutting elements nearer the outer edge will be travelling faster than those near the center of the bit.

As the drill string rotates the rotary cutting bit, the drill string can distort due to whirling or helical buckling. Helical buckling can cause the drill string to contact the walls of the hole, thereby generating frictional forces between the drill string and the walls. Accordingly, the rotational rate of the drill string can be controlled to control the frictional forces between the drill string and the walls of the hole.

In broken or unconsolidated formations that are difficult to drill, the hole walls can be sensitive to lateral pressure from the drill string and therefore speed is often limited to avoid whirling and helical buckling of the drill string which can damage the hole. This can in turn prevent the drill string from moving the cutting elements near the center of rotation at a sufficient speed to provide adequate penetration. Further, the torsional and frictional loads described above can cause helical buckling of the drill string, which in turn can damage the walls of the hole. If the hole becomes lost due to damage to the walls, the hole needs to be re-drilled, which can be extremely expensive.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

A down-the-hole assembly includes a housing having a central axis and a mechanical gear box positioned within the housing. The mechanical gear box is coupled to the housing such that rotation of the housing at a first rotational rate provides a rotary input to the mechanical gear box. A rotary cutting bit is coupled to the mechanical gear box. The mechanical gear box is configured to rotate said rotary cutting bit at a second rotational rate in response to that rotary input from the housing. The second rotational rate is greater than the first rotational rate. The mechanical gear box is also further configured to cause the rotary cutting bit to orbit about the central axis of the housing.

For example, a down-the-hole assembly can include a down-the-hole motor and a mechanical gear box coupled to the down-the-hole motor. The mechanical gear box can be adapted to receive a rotational input of a first rotational rate from the down-the-hole motor. The assembly can also include a rotary cutting bit coupled to the mechanical gear box. The mechanical gear box can be configured to rotate the rotary cutting bit at a second rotational rate in response to the rotational input from the down-the-hole motor. The second rotational rate can be greater than the first rotational rate.

Additionally, another down-the-hole drilling assembly in accordance with the present invention can include a housing and a down-the-hole motor coupled to the housing. The down-the-hole motor can be configured to rotate the housing at a first rotational rate. The assembly can also include a ring gear formed on an inner surface of the housing, a first gear adapted to intermesh with the ring gear, a second gear adapted to intermesh with the first gear; and a rotary cutting bit coupled to the first gear. Rotation of the housing at the first rotational rate can cause the rotary cutting bit to rotate at a second rotational rate while orbiting the housing. The second rotational rate can be greater than the first rotational rate.

In addition to the foregoing, a method of drilling can involve coupling a helical drilling device to a down-the-hole motor. The helical drilling device can include a mechanical gear box positioned within an internally geared housing. The helical drilling device can also include a rotary cutting bit coupled to the mechanical gear box. The method can also include activating the down-the-hole motor to rotate the internally geared housing at a first rotational rate thereby providing a rotary input to the mechanical gear box. The rotary input can cause the mechanical gear box to rotate a rotary cutting bit at a cutting rotational rate greater than the input rotational rate.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

A down-the-hole apparatus is provided herein that is configured to follow a generally helical path. In at least one example, the down-the-hole apparatus is coupled to a drill rod or drill string. The down-the-hole apparatus includes an integral gearbox, such as an integral mechanical gear box that utilizes the rotation of the drill string as an input to drive a rotary cutting bit. In particular, the mechanical gear box can include a gear train that increases the rotational rate of the rotary cutting bit relative to the rotational rate of the input provided by the drill string. Further, the mechanical gear box can cause the rotary cutting bit to orbit about a central axis of the down-the-hole apparatus. As a result, as a drilling system moves the drill string and the attached down-the-hole apparatus into a formation by applying feed pressure while rotating the drill string, the rotary cutting bit rotates at an increased speed while it travels along a generally helical path. Such a configuration and process can increase the cutting speed of the down-the-hole apparatus while drilling a hole larger than the diameter of the rotary cutting bit.

In particular, such a configuration can increase speed of all the cutting elements across the face of the hole end while maintaining drill string rotational speeds within acceptable levels. By adding a gearbox, the down-the-hole apparatus can provide significantly higher speeds to all the cutting elements (not just some of the elements) to thereby achieve unlimited penetration rates. For example, in a 45 mm diameter hole design utilizing a 2.6:1 gear ratio, a down-the-hole apparatus can achieve a minimum element speed of 1.27 times that of the fastest outer diameter element on a conventional rotary boring bit. In other examples, higher gear ratios can be provided to take advantage of available cutting element capacities and rig feed pressures all while maintaining torsional loads and frictional loads below acceptable levels.

Figure 1:
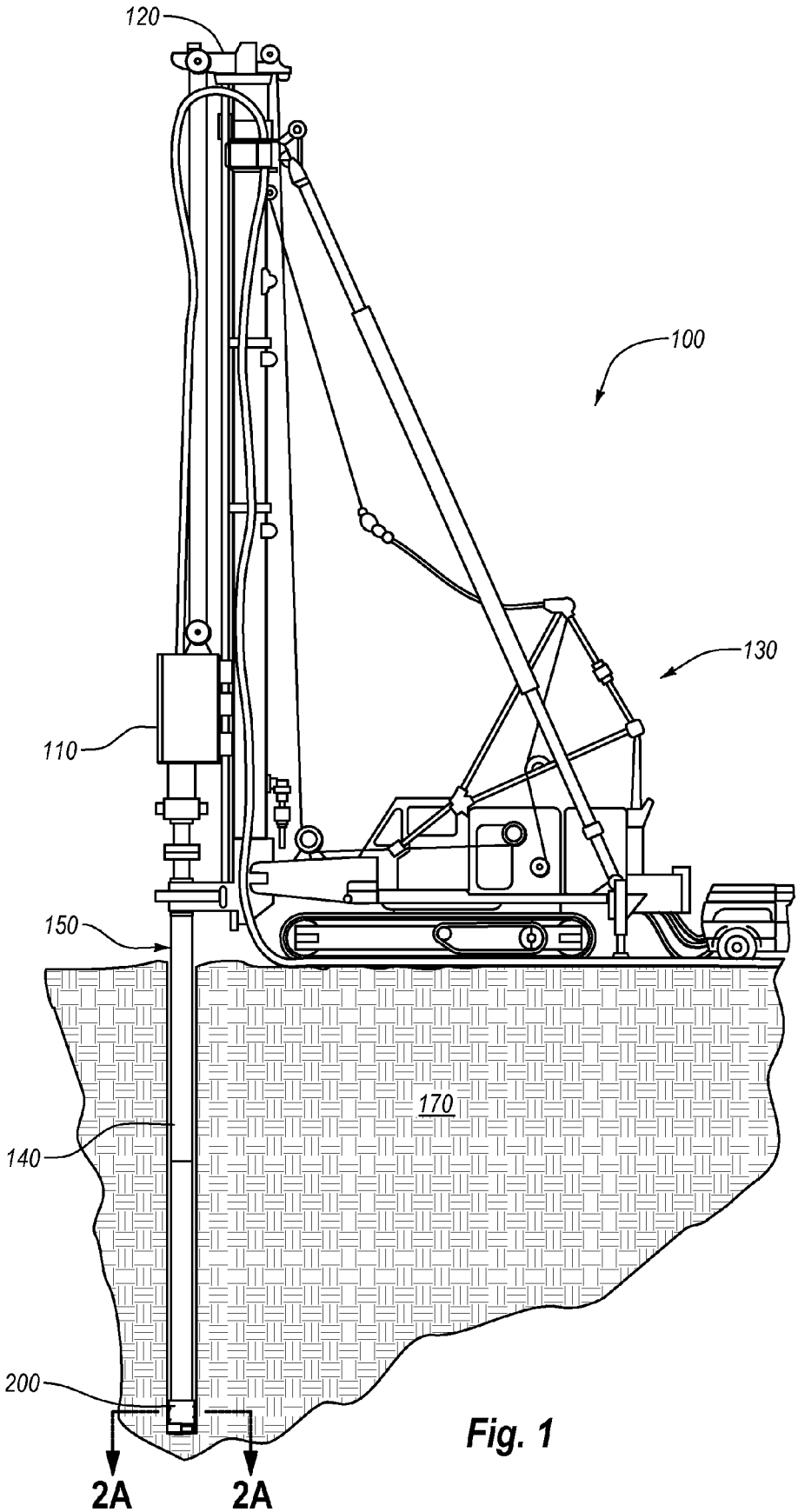
FIG. 1 illustrates a drilling system including a helical drilling apparatus according to one example.

FIG. 1 illustrates a drilling system 100 that includes a drill head assembly 110. The drill head assembly 110 can be coupled to a mast 120 that in turn is coupled to a drill rig 130. The drill head assembly 110 is configured to have a drill rod 140 coupled thereto. The drill rod 140 can in turn couple with additional drill rods to form a drill string 150. In turn, the drill string 150 can be coupled to a helical drilling apparatus 200 configured to interface with the material to be drilled, such as a formation 170.

In at least one example, the drill head assembly 110 is configured to rotate the drill string 150. In particular, the rotational rate of the drill string 150 can be varied as desired during the drilling process. Further, the drill head assembly 110 can be configured to translate relative to the mast 120 to apply an axial force to the drill head assembly 110.

In at least one example, as the drill head assembly 110 axially and rotationally drives the drill string 150 and thus the helical drilling apparatus 200 into the formation 170, the helical drilling apparatus 200 drives a rotary cutting bit at an increased rotational rate relative to rotational rate of the drill string 150 and causes the rotary cutting bit to travel along a generally helical path. Such a configuration and process can increase the cutting speed of the down-the-hole apparatus 200 while drilling a hole larger than the diameter of the rotary cutting bit. While a continuous drill string is shown that carries the helical drilling apparatus to interface with the formation 170, it will be appreciated that the helical drilling apparatus 200 can also be used with other systems, such as wireline system or other type of system.

Figure 2B:
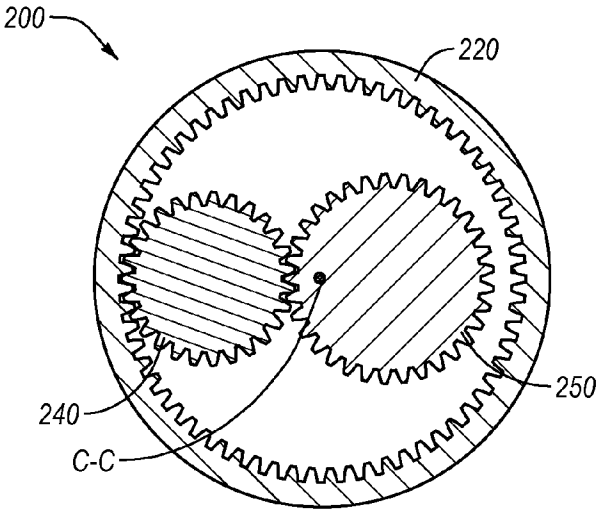
FIG. 2B illustrates a cross-sectional schematic view of a helical drilling apparatus taken along section 2B-2B of FIG. 2A.
Figure 2C:
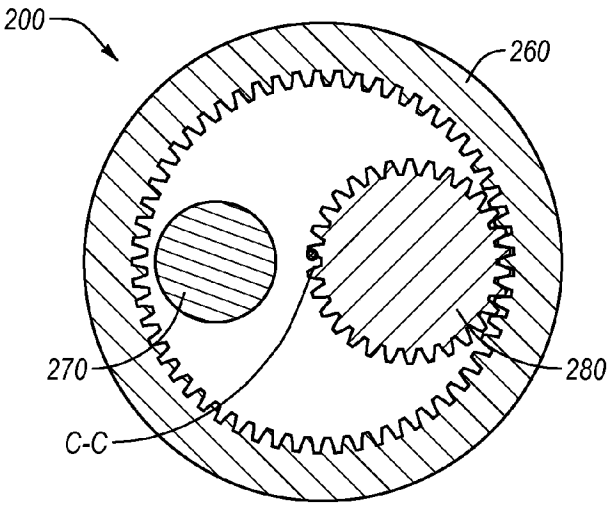
FIG. 2C illustrates a cross-sectional schematic view of a helical drilling apparatus taken along section 2C-2C of FIG. 2A.
Figure 2A:
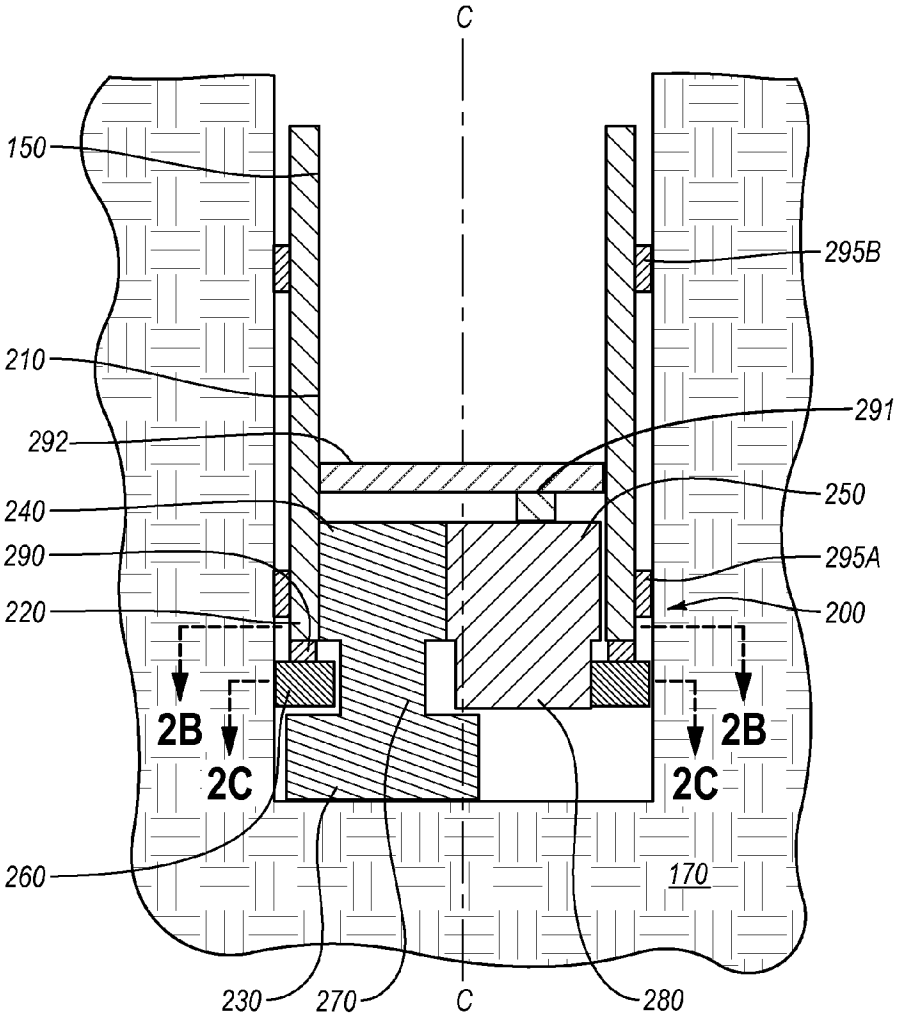
FIG. 2A illustrates a cross-sectional schematic view of a helical drilling apparatus taken along section 2A-2A of FIG. 1.

FIG. 2A illustrates cross-sectional view of the example helical drilling apparatus 200 taken along section 2A-2A of FIG. 1. As illustrated in FIG. 2A, the helical drilling apparatus 200 can generally include a housing 210 that is coupled to the drill string 150 in such a manner that rotation of the drilling string 150 also rotates the housing 210. In the illustrated example, the housing 210 can be generally hollow to thereby define a lumen therein.

In at least one example, a ring gear 220 can be coupled to or integrated with an inner surface of a bit end of the housing 210. The helical drilling apparatus 200 also includes a rotary cutting bit 230, a bit gear 240, an orbital gear 250, a grounding ring 260, a bit shaft 270, a grounding shaft 280, and a bearing 290. In the illustrated example, the bit gear 240 may be coupled to or integrated with the bit shaft 270 and the rotary cutting bit 230 such that the rotary cutting bit 230, the bit gear 240, and the bit shaft 270 rotate together. The example grounding shaft 280 may be coupled to or integrated with orbital gear 250 such that the orbital gear 250 and the grounding shaft 280 rotate together. In the illustrated example, the bearing 290 couples the grounding ring 260 to the housing 210 and/or the ring gear 220 in such a manner as to at least partially isolate the grounding ring 260 from direct rotation of the housing 210. The example ring gear 220 is driven by the rotation of the housing 210, which in turn may rotate in response to rotation of the drill string 150.

As illustrated in FIG. 2B, teeth on the ring gear 220 mesh with teeth on the bit gear 240 such that rotation of the ring gear 220 drives the bit gear 240. Teeth on the bit gear 240 also mesh with teeth on the orbital gear 250 such that the rotation of the bit gear 240 drives the orbital gear 250 and thus the grounding shaft 280 (FIG. 2C). As illustrated in FIG. 2C, teeth on the grounding shaft 280 mesh with teeth on the grounding ring 260. As shown in FIG. 2A, the grounding ring 260 in turn may be in contact with a relatively stationary objection, such as the formation 170 (FIG. 2A).

Still referring to FIG. 2A, the bearing 290 may at least partially isolate the grounding ring 260 from direct rotation of the housing 210. For example, contact between the formation 170 and the grounding ring 260 may provide a frictional force that acts to inhibit rotation of the grounding ring 260, thereby allowing the housing 210 to rotate while the grounding ring 260 remains relatively stationary or the grounding ring 260 at least rotates at a lower rate than the housing 210. If the grounding ring 260 is thus relatively stationary, rotation of the housing 210 may drive the grounding shaft 280 by way of the orbital gear 250, the bit gear 240, and the ring gear 220 as described above.

As shown in FIG. 2C, and as previously introduced, teeth on the grounding shaft 280 mesh with the teeth on the grounding ring 260. As a result, rotation of the grounding shaft 280 causes the teeth of the grounding shaft 280 to move into successive engagement with the teeth on the grounding ring 260. As the teeth of the grounding shaft 280 move into successive engagement with the grounding ring 260 the grounding shaft 280 moves around the perimeter of the relatively stationary grounding ring 260. As the grounding shaft 280 moves about the relatively stationary grounding ring 260, the grounding shaft 280 orbits about axis C-C of the helical drilling apparatus 200. As previously discussed, the grounding shaft 280 rotates with the orbital gear 250.

As a result, as the grounding shaft 280 obits about the central axis C-C, the orbital gear 250 (FIGS. 2A-2B) also orbits about the central axis C-C. In at least one example, the orbital gear 250 may be coupled to a bearing connection 291 which in turn may be coupled to a support plate portion 292 of the housing 210. The bearing connection and support plate portion 292 may cooperate to fix an axis of rotation of the orbital gear 250 to the central axis C-C without engagement between the orbital gear 250 and the ring gear 220. As a result, as shown in FIG. 2B the orbital gear 250 may not mesh with the ring gear 220 as desired.

As also shown in FIG. 2B, the orbital gear 250 meshes with the bit gear 240. As a result, as the orbital gear 250 orbits about the central axis C-C, the bit gear 240 also orbits about the central axis C-C. The bit gear 240 also rotates in response to the rotation of the housing 210. As shown in FIG. 2A, as the bit gear 240 rotates and orbits, the bit shaft 270 and the rotary cutting bit 230 also rotate.

As a result, when the rotary cutting bit 230 orbits about the central axis C-C, the rotary cutting bit 230 drills out the entire face of the hole. In particular, the outer perimeter of the face is cut by the exterior portions of the rotary cutting bit 230. As the rotary cutting bit 230 rotates and orbits about the central axis C-C, the rotary cutting bit 230 cuts a generally helical path in the formation 170. The cutting path of the rotary cutting bit 230 can have any desired width. In at least one example, the rotary cutting bit 230 can be as wide as or wider than approximately half the diameter of the housing. Such a configuration allows the rotary cutting bit 230 to drill an entire surface of a hole as the helical drilling apparatus 200 causes the rotary cutting bit 230 to orbit relative to the central axis C-C. Further, the rotary cutting bit 230 can rotate at a higher rotational rate than the rotational rate of the drill string 150 as described above.

As illustrated in FIG. 2B, the ring gear 220 includes a larger diameter than the bit gear 240. As a result, the ring gear 220 may have more teeth than the bit gear 250. The larger number of teeth on the ring gear 220 increases the rotational rate of the bit gear 240 relative to the rotational rate of the ring gear 220. In particular, the rotational rate of the bit gear 240 is substantially equal to the rotational rate of the ring gear 220 multiplied by the ratio of the number of teeth on the ring gear 220 to the number of teeth on the bit gear 240. In some examples, this ratio may be greater than about two, such that the rotational rate of the bit gear 240 can be greater than twice the rotational rate of the ring gear 220.

In at least one example, one or more sets of pads 295A, 295B can be used to stabilize a hole. In particular, the leading set of pads 295A can also contain traditional cutting elements to 'ream' or 'dress' the size and walls of the hole while trailing sets of pads 295B may abrade against the drill hole wall in the formation 170 at the trailing edge, thereby supporting and guiding the helical drilling apparatus 200.

As discussed, the rotary cutting bit 230 rotates at a higher speed than the housing 210 and the drill string 150. The high speed cutting of the rotary cutting bit 230 can increase the cutting rate of the drilling system at a given rotation of the drill string 150 by increasing the speed of each of the cutting elements relative to the housing 210.

Accordingly, such a configuration can increase speed of all the cutting elements across the face of the hole end in which the material is extremely hard or difficult to drill. By eliminating a stationary centre of rotation, and adding a gearbox, the down-the-hole apparatus can provide significantly higher speeds to all the cutting elements (not just some of the elements) to thereby achieve unlimited penetration rates. For example, in a 45 mm diameter hole design utilizing a 2.6:1 gear ratio, a down-the-hole apparatus can achieve a minimum element speed of 1.27 times that of the fastest outer diameter element on a conventional rotary boring bit. In other examples, higher gear ratios can be provided to take advantage of available cutting element capacities and rig feed pressures all while maintaining torsional loads and frictional loads below acceptable levels.

In the illustrated example, one configuration is illustrated and discussed. It will be appreciated that any mechanism, including any combination and location of gear trains can be used to increase or multiply the rotation of a rotary cutting bit relative to the drill string. Further, any combination and location of mechanisms, including above and/or below the bit gear, can be used to cause the rotary cutting bit to orbit a central axis. In addition, any number of bit gears and rotary cutting bits can also be utilized. Further, any number of stabilizing or other types of members can be utilized to stabilize, ream, and/or dress a wall of a borehole.

Figure 3:
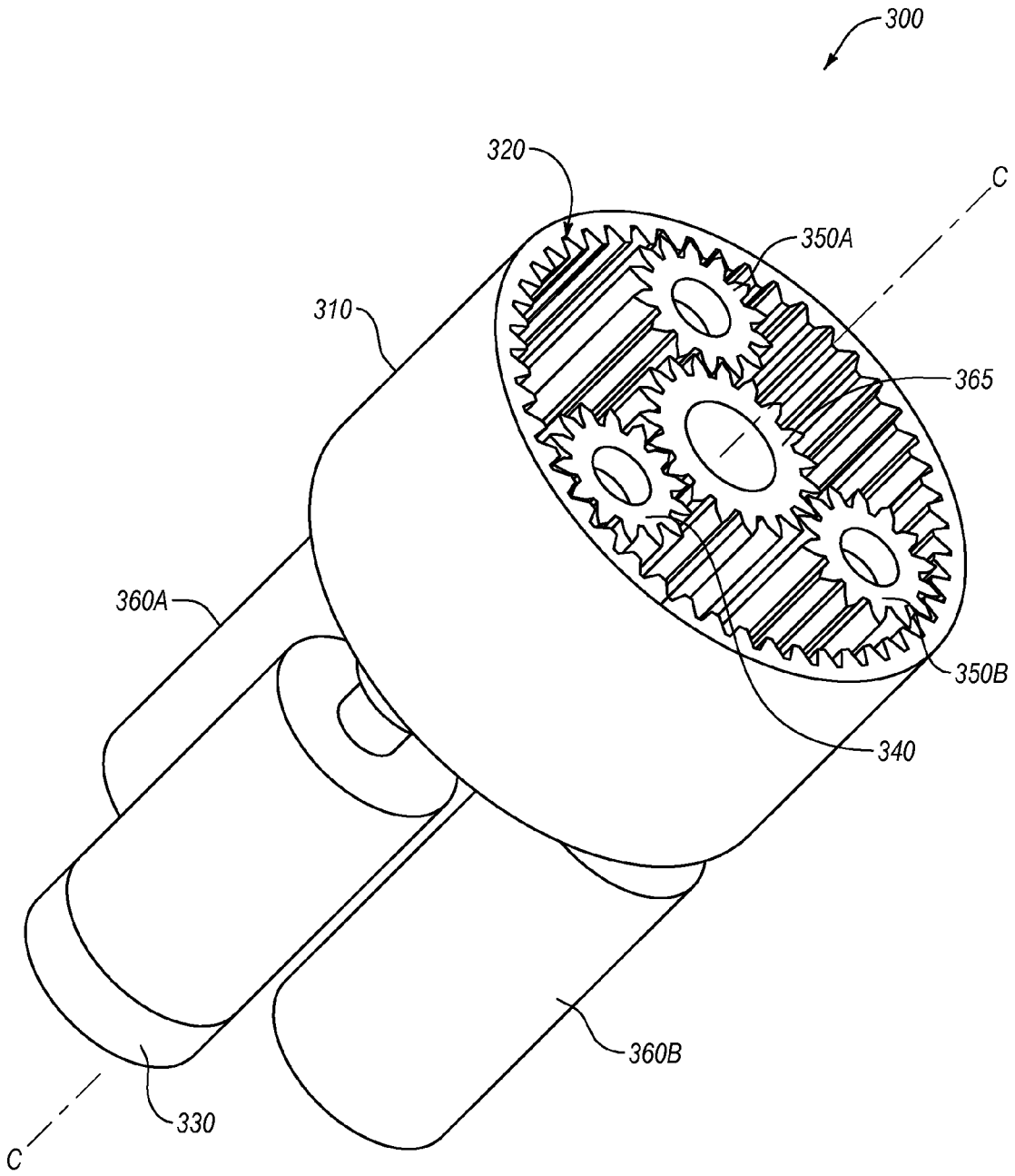
FIG. 3 illustrates a perspective view of a helical drilling apparatus according to one example.

One such example is illustrated in more detail FIG. 3. FIG. 3 illustrates a top perspective view of another exemplary helical drilling apparatus 300. As illustrated in FIG. 3, the example helical drilling apparatus 300 can generally include a housing 310 that is coupled to the drill string 150 (FIG. 1) in such a manner that rotation of the drilling string 150 also rotates the housing 310 as described above. The helical drilling apparatus 300 can further include a ring gear 320, a rotary cutting bit 330, a bit gear 340, orbital gears 350A, 350B, stabilizing members 360A, 360B, and an center gear 365.

The example ring gear 320 may be coupled to or integrated with the housing 310 as desired. The bit gear 340 is coupled to the ring gear 320 as well as the center gear 365 such that rotation of the ring gear 320 rotates the bit gear 340. In at least one example, the bit gear 340 may also be coupled to or integrated with the rotary cutting bit 330. As a result, the rotation of the bit gear 340 described above results in similar rotation of the rotary cutting bit 330. This motion may cause the rotary cutting bit 330 to cut a material with which it is in contact. As will be discussed in more detail below, the stabilizing members 360A, 360B and the orbital gears 350A, 350B may cooperate with the ring gear 320, the center gear 365, and/or the formation to cause the rotary cutting bit 330 to orbit about a central axis (not shown) of the helical cutting apparatus 300.

In at least one example, the center gear 365 may be prevented from rotating freely with respect to the ring gear 320. In other examples, the ring gear 320 may be prevented from rotating freely with respect to the center gear 365. Either of these configurations can allow the bit gear 340 to orbit about the ring gear 320. It will also be appreciated that other configurations and interactions can be utilized to cause the bit gear 340 to orbit about the ring gear 320. For ease of illustration, the example helically drilling apparatus 300 as having a center gear 365 which does not rotate freely with respect to the ring gear 320. Further, for ease of reference, the center gear 365 will be described as being stationary relative to the ring gear 320, though it will be appreciated that the center gear 365 may not be completely stationary.

As a result, as the bit gear 340 rotates in response to the input provided by the ring gear 320, teeth of the bit gear 340 move into successive engagement with the center gear 365. This successive engagement can cause the bit gear 340 to orbit about the ring gear 320. As a result, the bit gear 340 rotates and orbits to cut a generally helical path in a face of a bore hole.

In a similar manner as discussed above, the larger number of teeth on the ring gear 320 increases the rotational rate of the bit gear 340 relative to the rotational rate of the ring gear 320. In particular, the rotational rate of the bit gear 340 is substantially equal to the rotational rate of the ring gear 320 multiplied by the ratio of the number of teeth on the ring gear 320 to the number of teeth on the bit gear 340. Rotation of the bit gear 340 is transferred to the rotary cutting bit 330. The rotary cutting bit 330 can be as wide as or wider than approximately half the diameter of the housing. Such a configuration allows the rotary cutting bit 330 to drill an entire surface of a hole as the helical drilling device 300 causes the rotary cutting bit 330 to orbit relative to the central axis C-C.

In the illustrated example, the orbital gears 350A, 350B are also coupled to the ring gear 320 as well as the center gear 365 such that rotation of the ring gear 320 rotates the orbital gears 350A, 350B and orbit about the ring gear 320 in a similar manner as described above with reference to the bit gear 340. The orbital gears 350A, 350B can have any desired diameter. For example, the orbital gears 350A, 350B may be approximately the same diameter or may have different diameters. Further, the orbital gears 350A, 350B may have approximately the same diameter as the bit gear 340. In at least one example, the center gear 365 may have a diameter greater than one or more of the bit gear 340 and the orbital gears 350A, 350B.

In at least one example, the stabilizing members 360A, 360B may be coupled to or integrally formed with the orbital gears 350A, 350B as desired. As a result, the rotation of the orbital gears 350A, 350B results in similar rotation of the stabilizing members 360A, 360B. This rotation can allow the stabilizing members 360A, 360B to dress or ream the hole at the same time the rotary cutting bit 330 cuts at the face of the borehole. Any number of rotary cutting bits 330 may also be used as desired.

In at least one example, one or more of the stabilizing members 360A, 360B can be used to stabilize a hole, in addition to providing the orbital movement described above. Further, the stabilizing members 360A, 360B can also contain traditional cutting elements to 'ream' or 'dress' the size and walls of the hole. It will also be appreciated that rotary cutting bits may be used in conjunction with the stabilizing members 360A, 360B in conjunction with the traditional cutting elements or instead of the traditional cutting elements as desired.

Figure 4:
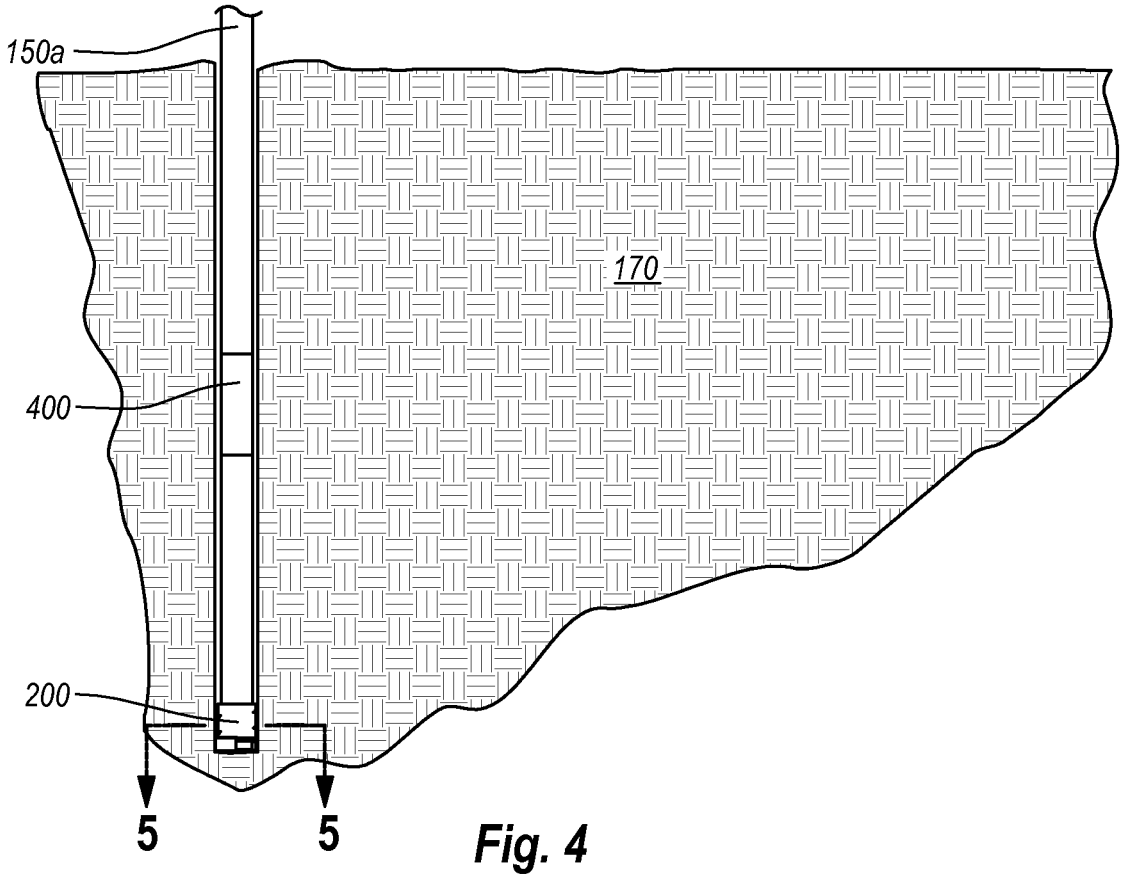
FIG. 4 illustrates another drilling system including a helical drilling apparatus according to an implementation of the present invention.

FIG. 4 illustrates a drilling system that may be used with a helical drilling apparatus of the present invention. The drilling system can include a drill string 150*a*, a down-the-hole motor 400, and a helical drilling apparatus 200, 300. In contrast to the implementations discussed herein above, a helical drilling apparatus 200, 300 used with the drilling system of FIG. 4 may not include a mechanism that grounds the device to the formation. Instead, the rotational difference between the drilling string 150*a* and the down-the-hole motor 400 can provide a ground to the helical drilling apparatus 200.

Specifically, in one or more implementations of the present invention the drill sting 150*a* can be configured as a rotationally stationary drill string 150*a*. In other words, in contrast with the drill string 150, the drill string 150*a* may not rotate (i.e., have a rotational rate of zero revolutions per minute). In such implementations, the rotational input to the helical milling machine 200, 300 may be provided by the down-the-hole motor 400.

Figure 5:
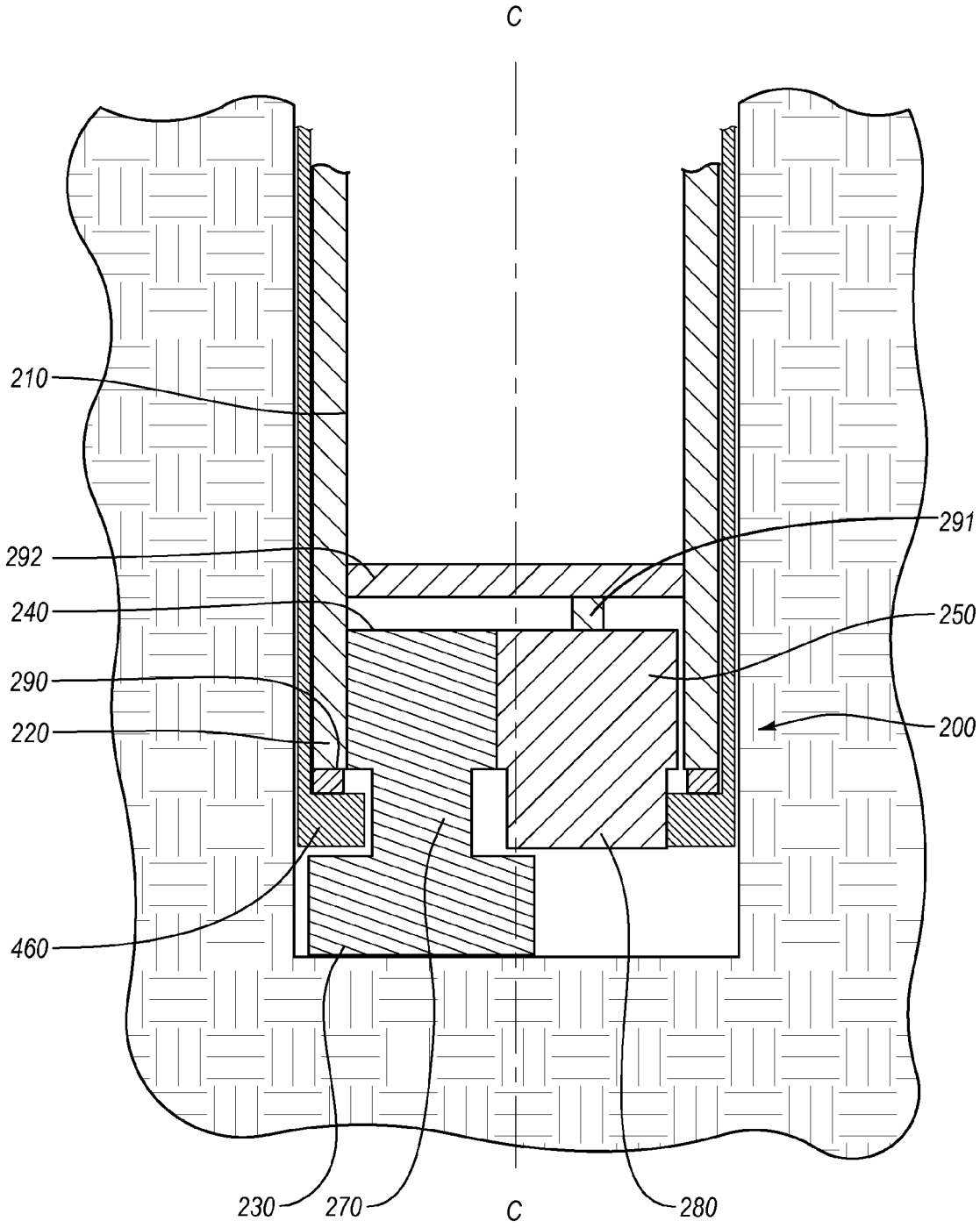
FIG. 5 illustrates a cross-sectional schematic view of a helical drilling apparatus taken along section 5-5 of FIG. 1.

For example, FIG. 5 illustrates a cross-sectional view of another example helical drilling apparatus 200*a* taken along section 5-5 of FIG. 1. The helical drilling apparatus 200*a* can be configured and function similar to the helical drilling apparatus 200 shown and described herein above, albeit with the changes described herein below.

Specifically, the helical drilling apparatus 200*a* can generally include a housing 210 that is coupled to down-the-hole motor 400 (in contrast to the drill string 150*a*) in such a manner that activation of the down-the-hole motor 400 rotates the housing 210. Furthermore, in at least one example, a ring gear 220 can be coupled to or integrated with an inner surface of a bit end of the housing 210. The helical drilling apparatus 200*a* can also include a rotary cutting bit 230, a bit gear 240, an orbital gear 250, a grounding ring 460, a bit shaft 270, a grounding shaft 280, and a bearing 290. In the illustrated example, the bit gear 240 may be coupled to or integrated with the bit shaft 270 and the rotary cutting bit 230 such that the rotary cutting bit 230, the bit gear 240, and the bit shaft 270 rotate together.

The example grounding shaft 280 may be coupled to or integrated with orbital gear 250 such that the orbital gear 250 and the grounding shaft 280 rotate together. In the illustrated example, the bearing 290 couples the grounding ring 460 to the housing 210 and/or the ring gear 220 in such a manner as to at least partially isolate the grounding ring 460 from direct rotation of the housing 210. The example ring gear 220 is driven by the rotation of the housing 210, which in turn may rotate in response to activation of the down-the-hole motor 400.

The grounding ring 460 can be coupled directly to the stationary drill string 150*a*. Thus, the grounding ring 460 can be configured not to rotate. The bearing 290 may at least partially isolate the grounding ring 460 from direct rotation of the housing 210. Thus, with the grounding ring 460 stationary, rotation of the housing 210 may drive the grounding shaft 280 by way of the orbital gear 250, the bit gear 240, and the ring gear 220 as described above.

As described herein above in relation to teeth on the grounding shaft 280 intermesh with the teeth on the grounding ring 460. As a result, rotation of the grounding shaft 280 causes the teeth of the grounding shaft 280 to move into successive engagement with the teeth on the grounding ring 260. As the teeth of the grounding shaft 280 move into successive engagement with the grounding ring 260 the grounding shaft 280 moves around the perimeter of the stationary grounding ring 460. As the grounding shaft 280 moves about the relatively stationary grounding ring 460, the grounding shaft 280 orbits about axis C-C of the helical drilling apparatus 200. As previously discussed, the grounding shaft 280 rotates with the orbital gear 250.

As a result, as the grounding shaft 280 obits about the central axis C-C, the orbital gear 250 also orbits about the central axis C-C. In at least one example, the orbital gear 250 may be coupled to a bearing connection 291 which in turn may be coupled to a support plate portion 292 of the housing 210. The bearing connection and support plate portion 292 may cooperate to fix an axis of rotation of the orbital gear 250 to the central axis C-C without engagement between the orbital gear 250 and the ring gear 220. As a result, as shown in FIG. 2B the orbital gear 250 may not mesh with the ring gear 220 as desired.

As also shown in FIG. 2B, the orbital gear 250 meshes with the bit gear 240. As a result, as the orbital gear 250 orbits about the central axis C-C, the bit gear 240 also orbits about the central axis C-C. The bit gear 240 also rotates in response to the rotation of the housing 210. As shown in FIG. 5, as the bit gear 240 rotates and orbits, the bit shaft 270 and the rotary cutting bit 230 also rotate.

As a result, when the rotary cutting bit 230 orbits about the central axis C-C, the rotary cutting bit 230 drills out the entire face of the hole. In particular, the outer perimeter of the face is cut by the exterior portions of the rotary cutting bit 230. As the rotary cutting bit 230 rotates and orbits about the central axis C-C, the rotary cutting bit 230 cuts a generally helical path in the formation 170. The cutting path of the rotary cutting bit 230 can have any desired width. In at least one example, the rotary cutting bit 230 can be as wide as or wider than approximately half the diameter of the housing. Such a configuration allows the rotary cutting bit 230 to drill an entire surface of a hole as the helical drilling apparatus 200*a* causes the rotary cutting bit 230 to orbit relative to the central axis C-C. Further, the rotary cutting bit 230 can rotate at a higher rotational rate than the rotational rate produced by the down-the-hole motor 400.

Thus, the housing 210 and ring gear 220 can rotate at a first rotational rate produced by the down-the-hole motor 400. The bit gear 240 and the rotary cutting bit 230 can rotate a second rotational rate that is greater than the first rotation rate. Furthermore, the grounding ring 460 can rotate a third rotational rate that is less than the first rotational rate. The third rotational rate can be equal to the rotational rate of the drill string 150*a*. Thus, when the drill string 150*a* is a stationary drills string, the third rotational rate can be zero.

In yet another implementation of the present invention, the drill string 150*a* can be configured to rotate similar to the drill string 150. In such implementations, the grounding ring 460 will accordingly also rotate. The difference in rotational rates of the drill string 150*a* (coupled to the grounding ring 460) and the down-the-hole motor 400 (coupled to the housing 210) can allow the grounding ring 460 to act as a ground while still rotating with the drill string 150*a*. In such implementations, the rotary cutting bit 230 can rotate at a higher rotational rate than the rotational rate produced by the down-the-hole motor 400, which is also rotating together with the drill string 150*a*.

Additionally, the helical drilling apparatus 300 can also be used in connection with the drilling system shown in FIG. 4. Specifically, referring to FIG. 3, the housing 310 can be coupled to the down-the-hole motor 400 in such a manner that activation of the down-the-hole motor 400 also rotates the housing 310 as described above. Furthermore, the center gear 365 can be coupled to the drill string 150*a*. Thus, the center gear 365 will remain stationary when the drill string 150*a* is configured to be stationary. When the drill string 150*a* is configured to rotate, the center gear 365 will rotate together with the drill string 150*a* at a slower rate than the housing 310 that is being rotated by the down-the-hole motor 400.

In yet further implementations, the center gear 365 can be coupled to the down-the-hole motor 400, which can provide the input to the helical drilling machine 300. In such implementations the housing 310 and associated ring gear 320 can be "grounded" by being coupled to a stationary drill string 150*a* or a relatively slower rotating drill string 150*a* when compared to the output of the down-the-hole motor 400.

In any event, as the bit gear 340 rotates in response to the rotational input provided by the down-the-hole motor 400, teeth of the bit gear 340 move into successive engagement with the center gear 365. This successive engagement can cause the bit gear 340 to orbit about the ring gear 320. As a result, the rotary cutting bit 330 rotates and orbits to cut a generally helical path in a face of a bore hole.

Thus, the housing 310 and ring gear 320 can rotate at a first rotational rate produced by the down-the-hole motor 400. The bit gear 340 and the rotary cutting bit 330 can rotate a second rotational rate that is greater than the first rotation rate. Furthermore, the center gear 365 can rotate a third rotational rate that is less than the first rotational rate. The third rotational rate can be equal to the rotational rate of the drill string 150*a*. Thus, when the drill string 150*a* is a stationary drills string, the third rotational rate can be zero.

In the implementations in which the center gear 365 is coupled to the down-the-hole motor 400 and the housing 310 is coupled to the drill string 150*a*, the center gear 365 can rotate at a first rotational rate produced by the down-the-hole motor 400. The bit gear 340 and the rotary cutting bit 330 can rotate a second rotational rate that is greater than the first rotation rate. Furthermore, the housing 310 and ring gear 320 can rotate a third rotational rate that is less than the first rotational rate. The third rotational rate can be equal to the rotational rate of the drill string 150*a*. Thus, when the drill string 150*a* is a stationary drills string, the third rotational rate can be zero.

In the illustrated examples, the relative sizes and/or configurations have been provided by way of example only. The relative sizes and the configurations are not necessarily to scale and may have been exaggerated for the sake of clarity and reference. It will be appreciated that the absolute and relative dimensions, including inner and outer dimensions, of each of the components can vary, including the dimension of the bit gear, the orbital gear, the bit shaft, the grounding shaft, and the grounding ring. Further, the number of bit gears and associated rotary cutting bits, the number of orbital gears and associated grounding members, as well the number of other components can be selected as desired and/or omitted as desired or appropriate.

Accordingly, relatives sizes, including gear ratios can vary, including gear ratios of the bit gear to the orbital gear, the orbital gear to the orbital shaft, the bit gear to the bit shaft, the ring gear to the grounding shaft, and other gear ratios. Further, any other dimensions and ratios can be selected as desired to achieve a desired rotational and/or orbital speeds at selected inputs.

Indeed, the helical drilling apparatus 200, 300, depending upon the particular configuration, can provide a wide variety of options and drilling speeds. For example, in some implementations the rotary cutting bit 230, 330 can be configured to rotate at a slower rate than the down-the-hole motor 400 or drill string 150. Specifically, the rotary cutting bit 230, 330 can be secured to a larger diameter gear than a rotational input gear. One will appreciate in light of the disclosure herein that such a configuration will reduce the rotational speed of the rotary cutting bit 230, 330, but increase the torque. Thus, the helical drilling apparatus 200, 300, can be configured to reduce or increase the rotational speed of a rotary cutting bit 230, 330 relative to a rotational input (e.g., down-the-hole 400 or drill string 150). This can allow a single rotational input (e.g., down-the-hole 400 or drill string 150) to provide various drilling speeds and torque. Thus, a signal rotational input (e.g., down-the-hole 400 or drill string 150) can be used to power a high speed diamond bit for hard rock drilling or a low speed high torque PCD bit for softer ground drilling. Indeed, the helical drilling apparatus 200, 300 can allow a drilling operation to switch between a high speed bit and a low speed high torque bit without having to change down-hole-motors.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claimed:

1. A down-the-hole assembly, comprising:
a down-the-hole motor;
a mechanical gear box coupled to the down-the-hole motor, the mechanical gear box being adapted to receive a rotational input of a first rotational rate from the down-the-hole motor, the mechanical gear box comprising:
a ring gear;
a bit gear operatively associated with the ring gear; and
at least one orbital gear operatively associated with the ring gear; and
a rotary cutting bit coupled to the mechanical gear box, the mechanical gear box being configured to rotate the rotary cutting bit at a second rotational rate in response to the rotational input from the down-the-hole motor, the second rotational rate varying from the first rotational rate;
a grounding ring operatively associated with at least one of the bit gear and an orbital gear of the at least one orbital gear; and
an isolation assembly configured to separate rotation of the ring gear from the grounding ring.

2. The assembly of claim 1, wherein the second rotational rate is greater than the first rotational rate.

3. The assembly of claim 1, wherein the second rotational rate is less than the first rotational rate.

4. The assembly of claim 1, wherein
a first orbital gear of the at least one orbital gear is operatively associated with the bit gear and with the ring gear.

5. The assembly of claim 4, wherein the rotary cutting bit is coupled to the bit gear.

6. The assembly of claim 1, wherein the ring gear is formed on an interior surface of a housing of the mechanical gear box.

7. The assembly of claim 1, wherein the grounding ring is coupled to a non-rotating drill string.

8. The assembly of claim 1, wherein the isolation mechanism comprises a bearing assembly.

9. The assembly of claim 1, wherein the mechanical gear box further comprises
a central gear operatively associated with each orbital gear of the at least one orbital gear and with the bit gear.

10. The assembly of claim 9, wherein the ring gear rotates freely relative to the central gear.

11. The assembly of claim 9, wherein the at least one orbital gear comprises a plurality of orbital gears.

12. A down-the-hole drilling assembly, comprising:
a housing;
a down-the-hole motor coupled to the housing, the down-the-hole motor being configured to rotate the housing at a first rotational rate;
a ring gear formed on an inner surface of the housing;
a first gear adapted to intermesh with the ring gear;
a second gear adapted to intermesh with the first gear; and
a rotary cutting bit coupled to the first gear;
a grounding ring operatively associated with at least one of the first gear and the second gear; and
an isolation mechanism configured to separate the rotation of the ring gear from the grounding ring,
wherein rotation of the housing at the first rotational rate causes the rotary cutting bit to rotate at a second rotational rate while orbiting the housing, the second rotational rate differing from the first rotational rate.

13. The down-the-hole drilling assembly of claim 12, further comprising a drill string adapted to rotate at a third rotational rate.

14. The down-the-hole drilling assembly of claim 12, wherein the third rotational rate is zero revolutions per minute.

15. The down-the-hole drilling assembly of claim 13, wherein the second gear is a center gear coupled to the drill string.

16. The down-the-hole drilling assembly of claim 13, wherein the second rotational rate is greater than the first rotational rate.

17. The down-the-hole drilling assembly of claim 13, wherein the second rotational rate is less than the first rotational rate.

18. A method of drilling, comprising:
coupling a helical drilling device to a down-the-hole motor, the helical drilling device comprising a mechanical gear box positioned within an internally geared housing and a rotary cutting bit coupled to the mechanical gear box, wherein the mechanical gear box comprises:
a ring gear;
a bit gear operatively associated with the ring gear; and
at least one orbital gear operatively associated with the ring gear;
operatively associated a grounding ring with at least one of the bit gear and an orbital gear of the at least one orbital gear; and
activating the down-the-hole motor to rotate the internally geared housing at a first rotational rate thereby providing a rotary input to the mechanical gear box;
wherein the rotary input causes the mechanical gear box to rotate a rotary cutting bit at a cutting rotational rate differing from the input rotational rate, and
wherein the helical drilling device further comprises an isolation mechanism configured to separate the rotation of the ring gear from the grounding ring.

19. The method of claim 18, further comprising spinning a drill string at a third rotational rate, the drill string being coupled to one or more gears of the mechanical gear box such that the one or more gears rotate at the third rotational rate.

20. The method of claim 19, wherein the third rotational rate is zero.

21. The method of claim 18, wherein the cutting rotational rate is greater than the input rotational rate.

22. The method of claim 18, wherein the cutting rotational rate is less than the input rotational rate.

23. A down-the-hole assembly, comprising:
a housing;
a down-the-hole motor coupled to the housing, the down-the-hole motor being configured to rotate the housing at a first rotational rate;

a rotary cutting bit;

a mechanical gear box comprising a first gear and one or more secondary gears, wherein the first gear is coupled to the housing and configured to rotate with the housing, and wherein at least one secondary gear is coupled to the rotary cutting bit;

a grounding ring operatively associated with at least one secondary gear of the plurality of gears of the mechanical gear box; and a bearing configured to at least partially isolate the grounding ring from rotation of the housing, wherein the mechanical gear box is configured to rotate the rotary cutting bit at a second rotational rate, wherein the second rotational rate is different than the first rotational rate.

24. The down-the-hole assembly of claim 23, further comprising a rotationally stationary drill string, wherein the grounding ring is coupled directly to the rotationally stationary drill string such that the grounding ring is rotationally stationary.

* * * * *